US007815032B2

(12) United States Patent
Preston et al.

(10) Patent No.: US 7,815,032 B2
(45) Date of Patent: Oct. 19, 2010

(54) PIPE ROLLER ASSEMBLY

(75) Inventors: Kevin L. Preston, Tomball, TX (US); H. Paul Reinhardt, Jr., Houston, TX (US); Loren D. Skiles, Tomball, TX (US)

(73) Assignee: Control Flow Inc., Houston, TX (US)

( * ) Notice: Subject to any disclaimer, the term of this patent is extended or adjusted under 35 U.S.C. 154(b) by 649 days.

(21) Appl. No.: 11/824,640

(22) Filed: Jul. 2, 2007

(65) Prior Publication Data

US 2009/0008513 A1 Jan. 8, 2009

(51) Int. Cl.
*B65G 47/46* (2006.01)

(52) U.S. Cl. ..... 198/369.6; 198/369.3; 198/370.09; 198/463.2

(58) Field of Classification Search ..... 198/370.04, 198/370.09, 597, 598, 369.3, 369.4, 369.6, 198/782, 786, 463.2, 463.3; 414/22.65, 745.4, 414/746.7, 746.4

See application file for complete search history.

(56) References Cited

U.S. PATENT DOCUMENTS 3,129,805 A * 4/1964 Krahn et al. ..... 198/783
3,348,678 A * 10/1967 Flowers ..... 198/369.3
3,446,367 A * 5/1969 Anderson ..... 198/782
4,067,450 A * 1/1978 Birdwell ..... 414/746.7
4,593,807 A * 6/1986 Cattaneo et al. ..... 198/463.3
5,450,943 A * 9/1995 Yew et al. ..... 198/468.6
5,878,863 A * 3/1999 Madden et al. ..... 198/370.04
6,149,376 A * 11/2000 Peting ..... 414/746.3
7,341,140 B1 * 3/2008 Warkentin ..... 198/369.3

* cited by examiner

*Primary Examiner*—James R Bidwell
(74) *Attorney, Agent, or Firm*—Greenberg Traurig LLP; Anthony F. Matheny

(57) ABSTRACT

Roller assemblies for transporting and laterally shifting pipe section, or joints, on oil and gas exploration and production laybarges, drilling/production vessels and platforms, and pipe spooling yards are disclosed. The roller assemblies comprise rollers that are capable of being tilted to facilitate lateral shifting of the pipe sections or joints. The roller assemblies comprise a frame, a tilting assembly, a roller frame pivotally connected to the tilting assembly and the frame, and a roller rotatably connected to the roller frame by an axle. The tilting assembly lifts one end of the roller frame to tilt the roller.

21 Claims, 2 Drawing Sheets

PIPE ROLLER ASSEMBLY

BACKGROUND

1. Field of Invention

The invention is directed to roller assemblies for transporting and lateral shifting pipe segments, or joints, such as on an offshore laybarge or onshore pipe spooling yard in the oil and gas exploration and production industry.

2. Description of Art

Typical laybarge and pipe spooling yards have a restriction on space. As a result, pipe segments, also referred to herein as pipe sections and pipe joints, are made-up prior to being run-in the wellbore or through the riser of an offshore platform or vessel by moving the individual pipe segments in an initial direction on roller assemblies, laterally moving the individual pipe segments to a second line of roller assemblies, and then moving the pipe segments in an opposite direction. This procedure is repeated until each pipe segment can be connected to another pipe segment. For example, a pipe joint may be initially stored on a storage rack. When the time comes to secure this pipe joint to another pipe joint, the pipe joint is transferred along a roller assembly from the storage stack toward the opposite end of the laybarge. The pipe joint is then laterally transferred from the first roller assembly to a second roller assembly or to the opposite side of a double roller assembly, i.e., a roller assembly having two independently rotatable rollers. Currently, the step of laterally moving each pipe segment requires the pipe segment to be lifted by a crane or other device and placed in the second roller assembly. The pipe joint can then be moved along this second roller assembly toward the end of the laybarge where the pipe joint was originally stored. This procedure can be repeated as necessary to move the pipe joint to the point where it is attached to another pipe joint prior to run-in.

SUMMARY OF INVENTION

The roller assemblies disclosed herein facilitate lateral movement of pipe joints from one line of roller assemblies to an adjacent line of roller assemblies. In one embodiment, the roller assemblies disclosed herein include at least one V-shaped roller. One end of the V-shaped roller includes a hinge that functions as a pivot point for rotating the V-shaped roller around this end of the V-shaped roller. Due to the rotation of the V-shaped roller around the pivot point, the V-shaped roller is tilted upward so that a pipe segment resting in the V-shaped roller can be rolled out of the V-shaped roller and into a second V-shaped roller. The second V-shaped roller may be disposed on a second roller assembly or may be part of the roller assembly having the first V-shaped roller. In other words, the roller assembly may have more than one V-shaped roller.

A hydraulic cylinder can be used to tilt the V-shaped roller and an electric or hydraulic motor can be used to drive or rotate the V-shaped roller such as through a chain and sprocket arrangement. In one specific embodiment, the V-shaped roller is formed of steel and includes a urethane or rubber coating. The assembly can be adjusted in size to accommodate pipe joints of varying sizes.

In accordance with the disclosure herein, in one specific embodiment, a roller assembly comprises a roller assembly for transporting and laterally shifting a pipe section. The roller assembly may comprise a frame having a first end and a second end; a tilting assembly, the tilting assembly having an upper end and a lower end, the lower end of the tilting assembly being connected to the first end of the frame; a roller frame having an inner end and an outer end, the outer end being pivotally connected to the upper end of the tilting assembly and the inner end being pivotally connected to the frame; and a roller rotatably connected to the roller frame by an axle.

A further feature of the roller assembly is that the lower end of the tilting assembly may be pivotally connected to the first end of the frame. Another feature of the roller assembly is that the roller assembly may further comprise a drive assembly, the drive assembly including a motor for rotating the axle and, thus, the roller. An additional feature of the roller assembly is that the drive assembly may include a chain and sprocket. Still another feature of the roller assembly is that the roller assembly may further comprise a second roller frame having an inner end and an outer end, the second roller frame being connected to the second end of the frame; and a second roller rotatably connected to the second roller frame by a second axle. A further feature of the roller assembly is that the roller assembly may further comprise a second tilting assembly, the second tilting assembly having an upper end and a lower end, the lower end of the second tilting assembly being connected to the second end of the frame and the outer end of the second roller frame being pivotally connected to the upper end of the second tilting assembly. Another feature of the roller assembly is that the lower end of the second tilting assembly may be pivotally connected to the second end of the frame. An additional feature of the roller assembly is that the roller assembly may further comprise a second drive assembly, the second drive assembly including a second motor for rotating the second axle and, thus, the second roller. Still another feature of the roller assembly is that the tilting assembly may include a hydraulic cylinder. A further feature of the roller assembly is that the frame may include a vertical support member having a perpendicularly disposed pipe support member. Another feature of the roller assembly is that the roller may have a V-shape.

In another embodiment disclosed herein, an improved roller assembly for transporting and laterally shifting a pipe section may comprise a roller frame having an inner end and an outer end and a rotatable roller connected thereto, the outer end being pivotally connected to a tilting assembly and the inner end being pivotally connected to a frame of the roller assembly so that upward movement of the outer end of the roller frame by the tiling assembly causes the roller frame to tilt.

A further feature of the improved roller assembly is that the tilting assembly may include an upper end and a lower end, the upper end being pivotally connected to the roller frame. Another feature of the improved roller assembly is that the lower end of the tilting assembly may be pivotally connected to the roller frame. An additional feature of the improved roller assembly is that the titling assembly may include a hydraulic cylinder.

In an additional embodiment disclosed herein, a method of transporting and laterally shifting a pipe section may comprise the steps of: (a) placing a pipe section on a roller of a roller assembly; (b) rolling the pipe section longitudinally along the roller; and (c) tilting one end of the roller to laterally move the pipe section off the roller.

A further feature of the method of transporting and laterally shifting a pipe section is that during step (c), the pipe section may be laterally moved to a second roller for movement of the pipe section longitudinally along the second roller. Another feature of the method of transporting and laterally shifting a pipe section is that step (c) may be performed by activating a hydraulic cylinder. An additional feature of the method of transporting and laterally shifting a pipe section is that step (c) may be performed by lifting an outer end of the roller upward while an inner end of the roller remains pivotally affixed to a frame of the roller assembly so that the outer end is raised higher than the inner end. Still another feature of the method of transporting and laterally shifting a pipe section is that step (b) may be performed by activating a motor operatively connected to an axle of the roller.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
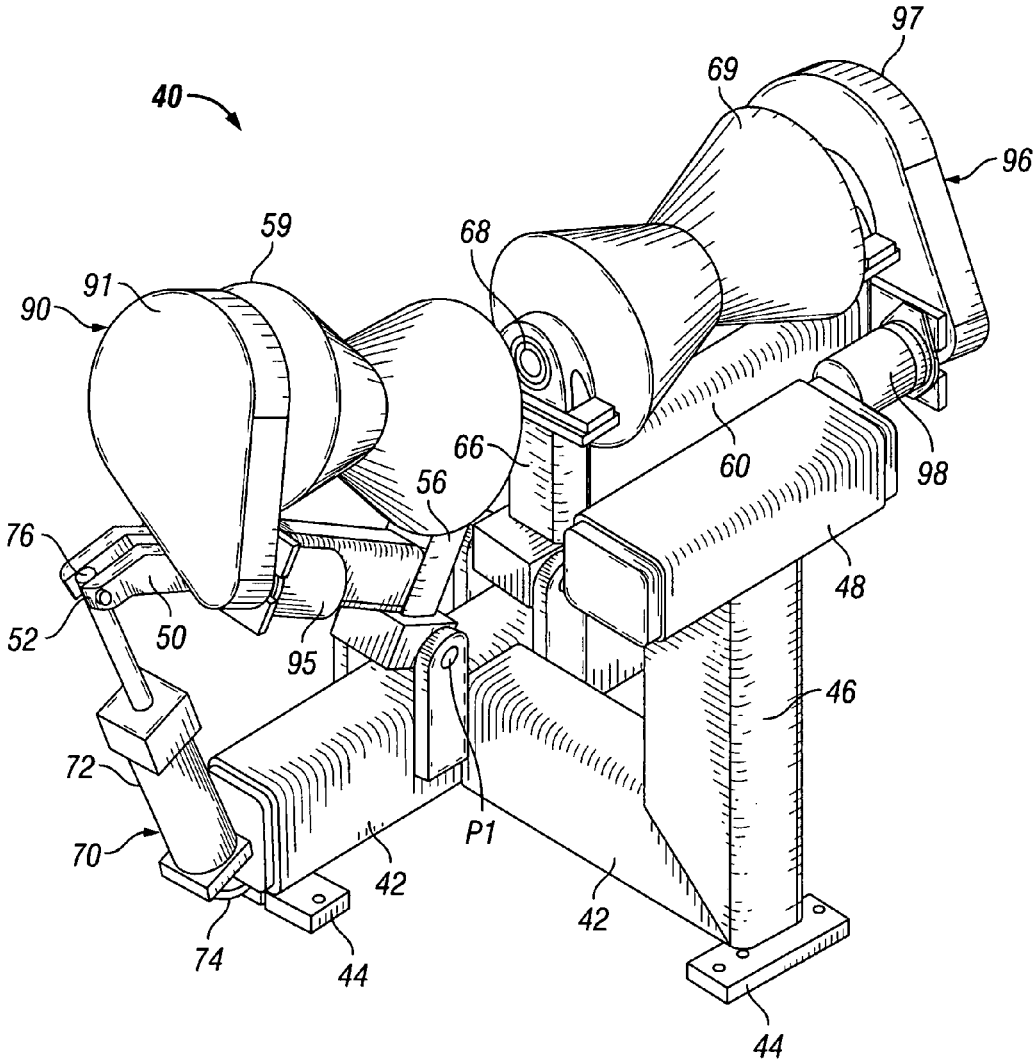
FIG. 1 is a perspective view of one specific embodiment of a roller assembly disclosed herein.
Figure 2:
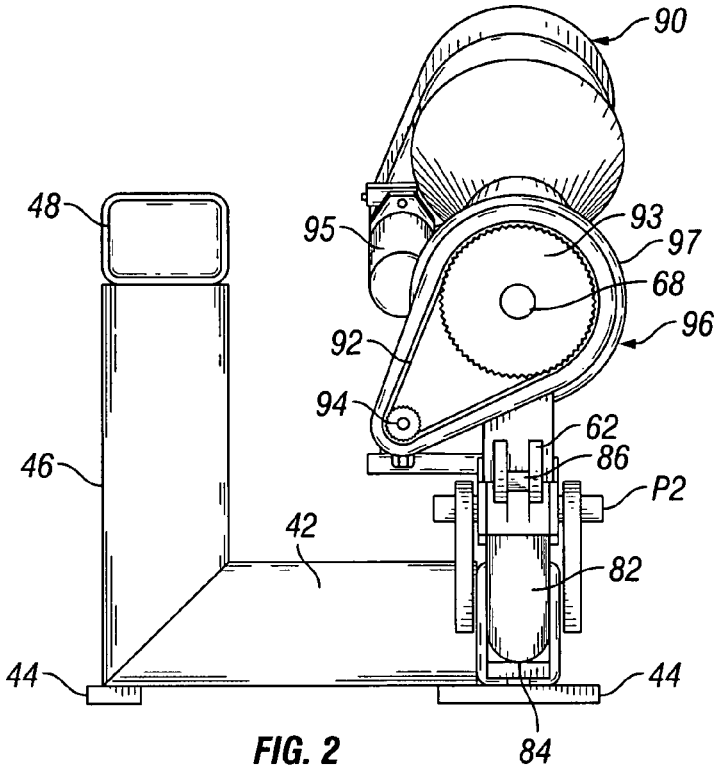
FIG. 2 is a side view of the roller assembly shown in FIG. 1.
Figure 3:
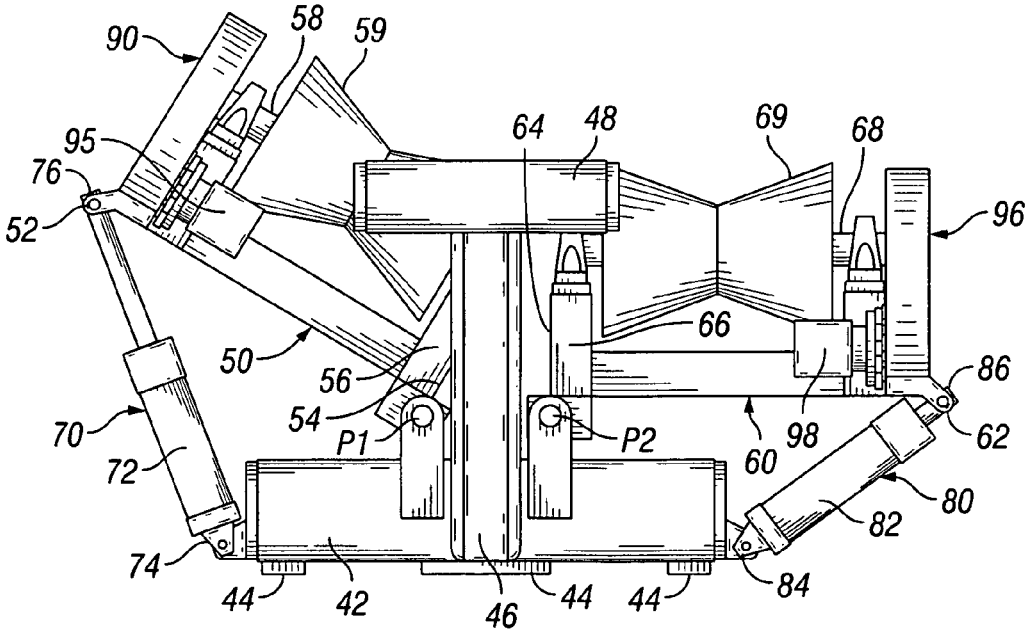
FIG. 3 is a front view of the roller assembly shown in FIG. 1.

Referring now to FIGS. 1-3, in one specific embodiment roller assembly 40 includes frame 42 having attachment members 44 for securing frame 42 to the laybarge or in onshore pipe spooling yard. Frame 42 also includes vertical member 46 having a perpendicular pipe support member 48 for supporting pipe as it is transported along roller assembly 40. In one embodiment, pipe support member is a steel support having a coating of urethane or rubber. As shown in the embodiment of FIGS. 1-3, frame 42 has a "T" shape with vertical member 46 being connected to the bottom of the "T-shaped" frame 42.

Frame 42 supports roller frames 50, 60 and tilting assemblies 70, 80. In the embodiment shown in FIGS. 1-3, tilting assemblies 70, 80 comprise hydraulic cylinders 72, 82 having lower ends 74, 84 and upper ends 76, 86. Lower ends 74, 84 are pivotally attached to frame 42. Upper ends 76, 86 are pivotally attached to outer ends 52, 62 of roller frames 50, 60, respectively. Inner ends 54, 64 of roller frames are pivotally attached to frame 42 at pivot points P1 and P2, respectively.

Roller frames 50, 60 include roller support members 56, 66 that connect inner ends 54, 64 of roller frames 50, 60 to axles 58, 68 of rollers 59, 69. As shown in FIGS. 1-3, axles 58, 68 extend continuously through rollers 59, 69, respectively. It is to be understood, however, that axles 58, 68 are not required to extend all the way through rollers 59, 69 and can instead extend from each outer end 52, 62 and inner end 54, 64 partially through each roller 59, 69.

Rollers 59, 69 may be any shape, and formed out of any material, desired or necessary to permit transportation of pipe longitudinally or axially along roller assembly 40 through rotation of rollers 59, 69. In the embodiment shown in FIGS. 1-3, rollers 59, 69 are hour-glassed or V-shaped. In another embodiment, rollers 59, 69 are urethane or rubber coated steel rollers.

Roller frames 50, 60 also include drive assemblies 90, 96 that connect outer ends 52, 62 of roller frames 50, 60 to axles 58, 68. Drive assemblies 90, 96 facilitate rotation of rollers 59, 69 so that pipe joint, or segment, (not shown) can be rolled longitudinally or axially along rollers 59, 69. Drive assemblies 90, 96 comprise housings 91, 97 having within in them a drive system such as chain 92 and sprockets 93, 94 shown in FIG. 2 or a belt drive (not shown). In the embodiment of FIGS. 1-3, the drive system connects axles 58, 68 with motors 95, 98 through drive shafts operatively associated with sprocket 94. Motors 95, 98 may be hydraulically activated or electrically activated.

In one embodiment of the operation of roller assembly 40, roller frame 50 is initially placed in the fully level position. The term "fully level position" means roller frame 50 is placed in a position to facilitate axial or longitudinal movement of the pipe segment through rotation of roller 59 such as by activation of motor 95. After the pipe segment is moved as far as necessary longitudinally along roller 59, hydraulic cylinder 72 is activated, i.e., extended, causing outer end 52 of roller frame 50 to be lifted upward which in turn causes roller frame 50 to tilt until roller frame 50 reaches the fully tilted position. Although, each roller frame 50, 60 will have numerous "tilted positions," i.e., positions in which the outer end of the roller assembly is disposed above the inner end of the roller assembly, the term "fully tilted position" is used herein to describe the tilted position at which the pipe segment resting in the roller of the roller assembly is capable of being moved laterally due to the force of gravity.

Also in this embodiment of the operation of roller assembly 40, roller frame 60 is likewise initially in the fully level position. When roller frame 50 reaches its fully tilted position, the pipe segment within roller 59 rolls laterally out of roller 59 and into roller 69 due to gravity. After the pipe segment is within roller 69, roller 69 is rotated, such as by activation of motor 98, and the pipe segment is moved longitudinally or axially along roller 69 until the pipe segment reaches another roller assembly for lateral movement or until the pipe segment reaches a second pipe segment for connection to the second pipe segment.

Although the foregoing description of the operation of roller assembly 40 describes various movements of roller assemblies 50, 60 it is to be understood that FIGS. 1-3 show roller frame 50 in a tilted position and roller frame 60 in the fully level position.

It is to be understood that the invention is not limited to the exact details of construction, operation, exact materials, or embodiments shown and described, as modifications and equivalents will be apparent to one skilled in the art. For example, the embodiment shown in FIGS. 1-3 is a "double" roller assembly having two rollers 59, 69. However, it is to be understood that other embodiments of roller assemblies may have a single roller or more than two rollers. Additionally, the pipe segment is not required to roll laterally onto an adjacent roller assembly. The pipe segment can be rolled laterally onto a storage rack or other location. Further, the tilting assembly is not required to be pivotally connected to the frame. Moreover, the inner end of the roller frame may be permitted to slide along the frame during tilting. Additionally, a ratchet system may be included as part of the roller assembly such that the roller frames cannot fall from the tilted positions to the fully level positions should the tilting assemblies fail. Accordingly, the invention is therefore to be limited only by the scope of the appended claims.

What is claimed is:

1. A roller assembly for transporting and laterally shifting a pipe section, the roller assembly comprising:

a frame having a first end and a second end;

a tilting assembly, the tilting assembly having an upper end and a lower end, the lower end of the tilting assembly being connected to the first end of the frame;

a roller frame having an inner end and an outer end, the outer end being pivotally connected to the upper end of the tilting assembly and the inner end being pivotally connected to the frame; and a roller rotatably connected to the roller frame by an axle, the roller comprising a concave shape providing a concave portion for receiving a pipe section disposed on the roller within the concave portion, wherein the tilting assembly pivots the roller frame a distance sufficient to shift the pipe section laterally off of the roller.

2. The roller assembly of claim 1, wherein the lower end of the tilting assembly is pivotally connected to the first end of the frame.

3. The roller assembly of claim 1, further comprising a drive assembly, the drive assembly including a motor for rotating the axle and, thus, the roller.

4. The roller assembly of claim 3, wherein drive assembly includes a chain and sprocket.

5. The roller assembly of claim 1, further comprising:

a second roller frame having an inner end and an outer end, the second roller frame being connected to the second end of the frame; and a second roller rotatably connected to the second roller frame by a second axle.

6. The roller assembly of claim 5, further comprising:

a second tilting assembly, the second tilting assembly having an upper end and a lower end, the lower end of the second tilting assembly being connected to the second end of the frame and the outer end of the second roller frame being pivotally connected to the upper end of the second tilting assembly.

7. The roller assembly of claim 6, wherein the lower end of the second tilting assembly is pivotally connected to the second end of the frame.

8. The roller assembly of claim 7, further comprising a second drive assembly, the second drive assembly including a second motor for rotating the second axle and, thus, the second roller.

9. The roller assembly of claim 1, wherein the tilting assembly includes a hydraulic cylinder.

10. The roller assembly of claim 1, wherein the frame includes a vertical support member having a perpendicularly disposed pipe support member.

11. The roller assembly of claim 1, wherein the concave shape comprises a V-shape.

12. An improved roller assembly for transporting and laterally shifting a pipe section, the improvement comprising a roller frame having an inner end and an outer end and a rotatable roller connected thereto, the roller having a concave shape, the outer end being pivotally connected to a tilting assembly and the inner end being pivotally connected to a frame of the roller assembly so that upward movement of the outer end of the roller frame by the tiling assembly causes the roller frame to tilt, thereby causing a pipe section disposed on the roller assembly to be moved laterally off of the roller assembly.

13. The improved roller assembly of claim 12, wherein the tilting assembly includes an upper end and a lower end, the upper end being pivotally connected to the roller frame.

14. The improved roller assembly of claim 13, wherein the lower end of the tilting assembly is pivotally connected to the roller frame.

15. The improved roller assembly of claim 14, wherein the titling assembly includes a hydraulic cylinder.

16. A method of transporting and laterally shifting a pipe section, the method comprising the steps of (a) placing a pipe section on a roller of a roller assembly, the roller comprising a concave shape providing a concave portion within which the pipe section is placed on the roller;

(b) rolling the pipe section longitudinally along the roller; and (c) tilting one end of the roller to laterally move the pipe section off the roller.

17. The method of claim 16, wherein during step (c), the pipe section is laterally moved to a second roller for movement of the pipe section longitudinally along the second roller.

18. The method of claim 16, wherein step (c) is performed by lifting an outer end of the roller upward while an inner end of the roller remains pivotally affixed to a frame of the roller assembly so that the outer end is raised higher than the inner end.

19. The method of claim 18, wherein step (c) is performed by activating a hydraulic cylinder.

20. The method of claim 19, wherein step (b) is performed by activating a motor operatively connected to an axle of the roller.

21. A roller assembly for transporting and laterally shifting a pipe section, the roller assembly comprising:

a frame having a first end and a second end;

a tilting assembly, the tilting assembly having an upper end and a lower end, the lower end of the tilting assembly being connected to the first end of the frame;

a roller frame having an inner end and an outer end, the outer end being pivotally connected to the upper end of the tilting assembly and the inner end being pivotally connected to the frame;

a roller rotatably connected to the roller frame by an axle; and a drive assembly, the drive assembly including a motor for rotating the axle and, thus, the roller.

* * * * *